United States Patent [19]

MacCarthy

[11] 4,290,224

[45] Sep. 22, 1981

[54] TAPE-SUPPORTED YO-YO

[75] Inventor: Patrick MacCarthy, Golden, Colo.

[73] Assignees: Ramon E. Bisque; Franklin J. Stermole, both of Golden, Colo. ; a part interest to each

[21] Appl. No.: 138,729

[22] Filed: Apr. 9, 1980

[51] Int. Cl.[3] ..... A63H 27/12

[52] U.S. Cl. ..... 46/61

[58] Field of Search ..... 46/61, 64, 67, 70, 71

[56] References Cited

U.S. PATENT DOCUMENTS

| | | | |
|---|---|---|---|
| 1,876,481 | 9/1932 | Wright | 272/8 R X |
| 2,773,328 | 12/1956 | Fraenkel et al. | 46/61 |
| 2,975,547 | 3/1961 | Greve | 46/61 X |
| 3,207,508 | 9/1965 | Klemke | 46/61 |
| 3,228,140 | 1/1966 | White | 46/61 |
| 3,256,635 | 6/1966 | Radovan | 46/61 |
| 3,263,361 | 8/1966 | Bowden | 46/61 |
| 3,452,470 | 7/1969 | Wohlstrom | 46/62 |
| 3,858,348 | 1/1975 | Brown | 46/61 |
| 4,086,722 | 5/1978 | Brown | 46/61 |
| 4,129,961 | 12/1978 | Parodi | 46/64 |
| 4,138,798 | 2/1979 | Washington | 46/59 |

OTHER PUBLICATIONS

"Experimental Fun with the Yo-Yo and Other Science Projects"; Renner, AL G.; Dodd, Mead & Co., N.Y. ©1979.

Duncan Yo-Yo "Swivel EZE" Finger Control Accessory.

*Primary Examiner*—Gene Mancene

*Assistant Examiner*—Mickey Yu

*Attorney, Agent, or Firm*—Sughrue, Mion, Zinn, Macpeak & Seas

[57] ABSTRACT

A toy having combined rotational motion about a horizontal axis and translational motion in a vertical direction. Two parallel discs are connected through their centers by a single axle. One end of a torsion resistant tape is attached to the axle, at a position between the two discs. A swivel system is attached to the other end of the tape, and a ring for holding the toy is attached to the swivel system. In order to operate the toy, the user's finger is placed in the ring and an up-and-down motion is initiated. The balance of the toy during operation is facilitated by the support provided to the axle along the width of the tape.

4 Claims, 2 Drawing Figures

TAPE-SUPPORTED YO-YO

BACKGROUND OF THE INVENTION

1. Field of the Invention

This invention relates to the field of rotating toys. More specifically, the invention relates to a tape-supported yo-yo consisting of a tape connected at one of its ends to the axle of the yo-yo. An operator holds the other end of the tape in his hand and can provide periodic, gentle, upward impulses to the tape in order to maintain the yo-yo in operation. A swivel system, connected to the end of the tape opposite the end which is attached to the axle, greatly facilitates operation of the yo-yo.

2. Description of the Prior Art

The prior art reveals various toys having combined rotational motion about a horizontal axis and a translational motion in a vertical direction. One type of such toy is commonly referred to as a yo-yo. This toy has also been referred to as a return top; quiz; prince of Wales' toy; Bandalore; or émigrette. A conventional yo-yo consists of a single axle having two parallel positioned discs centrally connected to the axle. A string is connected to the axle between the discs at one end and is held in the user's hand at the other end. The string is wrapped around the axle by the user and then is forced downward. Upon being forced downward, the string unwinds and provides a rotational momentum to the discs. Once the string has beem completely unwound, the rotational momentum of the discs continues to exist, thus causing the string to be rewound around the axle as it travels upward vertically toward the user's hand. The conventional structure of this yo-yo is disclosed within U.S. Pat. No. 3,263,361 to Bowden, and U.S. Pat. No. 3,256,635 to Radovan.

The conventional yo-yo structure as described above has achieved tremendous success in the past as an entertaining toy. Furthermore, certain modifications of that conventional yo-yo such as that disclosed within Bowden may have achieved success as entertaining toys. However, the conventional yo-yo structure has a pronounced limitation when used by inexperienced or younger operators. The limitation is apparent to even the most casual observer and resides in the ability to maintain the balance or equilibrium of the toy during use. The inability of the inexperienced user to maintain this balance results in a wobbling and precessional motion of the yo-yo during operation. The operator loses control of the yo-yo when the balance of the toy is disturbed, thus causing the yo-yo to slow its rotational motion and thereby lose its ability to maintain vertical translational motion.

Even though the specific problem of the inexperienced user's inability to maintain the balance of the yo-yo is apparent, the solution to the problem had not been solved until the presentation of an invention disclosed in U.S. Pat. application with Ser. No. 120,289. Prior attempts at modifying the conventional yo-yo structure are disclosed within U.S. Pat. No. 3,207,508 to Klemke and U.S. Pat. No. 3,228,140 to White. The modifications of Klemke and White may provide additional temporary balance to the horizontal stability of the axle by attaching two separate strings to the yo-yo axle at two separate points. However, those devices make no provision for the possibility of one of the strings being wound around the axle more quickly than the other, thus resulting in tilting. That problem is considered and solved in the invention of MacCarthy, U.S. Patent application of Ser. No. 120,289. My copending U.S. Patent application Ser. No. 120,289, was filed Feb. 11, 1980.

Other modifications to conventional yo-yo structure have been developed within the prior art. These modifications include the addition of steel rings to the discs of the yo-yo. Some of the modifications have been directed towards improving the stability of the yo-yo. Other modifications to the conventional yo-yo structure do not have as their purpose the improvement of the stability of the yo-yo, but rather providing a toy having added versatility and function, thus requiring greater skill and manual coordination for their operation.

Accordingly, the prior art appears to be comprised of yo-yo toys of conventional structure, conventional yo-yos with slight aesthetic modifications, yo-yos whose structure has been modified with the intent of providing improved stability, and yo-yos whose conventional structure has been modified with the intent of providing additional versatility and function. The structure of the present invention removes it from being classified strictly as a conventional yo-yo. Although the present invention may be modified aesthetically to produce graphic, light and sound effects, the structural differences between the present invention and a conventional yo-yo indicate that the present invention is more than a mere modification of conventional structure intended to bring out merely aesthetic differences over a conventional yo-yo.

U.S. Patent application of Ser. No. 120,289 describes a yo-yo which is more stable and versatile than the conventional yo-yo and prior modifications thereof. The present invention describes an alternative and distinct method for increasing the stability and versatility of the yo-yo so that it can be readily used by inexperienced persons or by very young children. The yo-yo of the present invention differs from all previous yo-yo designs. Basically, the yo-yo of the present invention consists of an axle, two discs centrally mounted on this axle, a tape, one end of said tape connected to said axle at a position between said discs, a swivel system attached to other end of said tape, and a holding ring attached to the swivel system. This novel design results in a yo-yo toy having dramatically improved stability and remarkably increased versatility over previous yo-yo designs. The design inherent in the present invention was arrived at after considering and constructing many more complex but less satisfactory models.

Although the structure of the present invention was intended to and did result in a toy having increased stability over a conventional yo-yo structure, the present invention is also capable of certain increased versatility of function over conventional yo-yo toys.

In the context of this Specification the term 'stability of yo-yo' is intended to mean the tendency of the yo-yo axle to remain in horizontal alignment, and its tendency to return to this alignment if it is displaced therefrom by some means. The term 'stability of yo-yo' also refers to the facility with which proper yo-yo operation can be re-established after it experiences severe wobbling or precessional rotation; the greater the stability of the yo-yo, the easier it is to re-establish proper operation after it encounters difficulty.

As an indication of the enhanced stability and ease of operation inherent in the yo-yo of the present invention, the following, illustrative examples may be given; after minimal practice a child of four to five years old can easily operate the yo-yo. In fact, the yo-yo is stabilized to such a degree and its ease of operation is so pronounced that it could be figuratively referred to as a yo-yo with training wheels, implying that it is suitable for children who have not yet mastered the art of using the conventional string yo-yo.

As an indication of the increased versatility of the yo-yo presented herein, the user will find that the yo-yo can be handled quite roughly during its operation, and still, the user continues to retain control of its motion. For example, while the yo-yo is in use it may be swung sideways, parallel to the direction of the yo-yo axis. Even though this induces a severe gyroscopic precession of the yo-yo body about a vertical axis, proper functioning of the yo-yo can be readily regained. With conventional designs, this gyroscopic precession also occurs, and generally it causes the operator to lose control of its motion. This ability to recover, even after severe twisting about a vertical axis, is a unique advantage of the present invention and adds considerable versatility to its use. As well as demonstrating increased versatility, these observations also provide further confirmation of the remarkable stability of the present yo-yo.

As a further indication of the versatility of the present yo-yo, the user will find that it is a simple matter to operate the yo-yo by suspending it from one's mouth, or by standing on a chair, table, or other elevated platform, and suspending it from one's foot.

Another feature inherent in the present invention is the smoothness and increased translational velocity of its motion. The smoothness results from the fact that the tape lies neatly on top of itself, unlike a string which typically winds in a somewhat random manner. The increased translational velocity results from the increasing diameter of the effective axle as the tape is wrapped in a spiralling manner upon itself as the yo-yo body rotates on its upward swing.

The ease of operation and smoothness of motion make the present yo-yo a pleasurable toy for both young and old. Due to its stability, less concentration is required for using the present invention during normal operation than is required for operating a conventional yo-yo, and it is considerably easier to regain proper functioning of the yo-yo when it encounters difficulty.

SUMMARY OF THE INVENTION

The presently claimed invention is comprised of a single axle which connects two parallel discs at their centers. A tape is connected at one of its ends to the axle, between the discs. In order to operate the yo-yo, the user must support the tape at its other end and move that end gently up and down. Increased horizontal stability is provided to the axle by the tape, since the axle is supported along the width of the tape.

In a preferred embodiment of the present invention a system of one or more swivels is attached to the end of the tape opposite the end of attachment to the axle. A holding ring is attached to the swivel system. In order to operate the preferred embodiment of the present invention, the user places his finger through the holding ring. After winding the tape around the axle, the body of the yo-yo is allowed to fall. Thereafter, gentle up and down oscillatory motion is maintained to keep the body of the yo-yo rotating, and thus sustaining its vertical up-and-down motion. The swivel system, consisting of one or more swivels, allows relaxation of the rotational tension in the tape resulting from twisting of the tape about a vertical axis. This significantly facilitates operation of the toy.

In accordance with the above-presented description of the invention, and a further description which will follow, it is the primary object of this invention to provide a toy comprised of an axle; two discs supported at their center points on said axle; a ribbon or a tape connected at one of its ends to said axle.

Another object of the present invention is to provide a yo-yo which is composed of an axle; two discs supported at their center points on said axle; a tape connected at one of its ends to said axle; a system of one or more swivels connected to the opposite end of said tape; a holding ring attached to said swivel system.

Another object of the present invention is to provide a yo-yo toy that is more stable than a conventional yo-yo toy.

Another object is to develop a yo-yo which is considerably simpler to operate than a conventional yo-yo, in that less skill is required to operate it, thus making it more attractive to the novice yo-yo operator.

Still another object of the present invention is to present a yo-yo toy which is simple in design and in construction.

Another object of the invention is to present a yo-yo toy which possesses such greatly increased stability that it results in increased versatility of the function of the toy.

Another object of the present invention is to present a yo-yo toy of such design that difficulties due to precessional rotation can be readily rectified and proper yo-yo operation reinstated without having to stop the yo-yo and start all over again.

Yet another object of the present invention is to present a yo-yo toy which lends itself to further ornamental and decorative features, by incorporating various designs and patterns on the tape, thus giving the device a more colorful and attractive appearance.

These and other objects and advantages of the present invention will become apparent to those skilled in the art upon reading the details of construction and use as more fully set forth below, reference being made to the accompanying drawings forming a part hereof wherein like numerals refer to like parts throughout.

DESCRIPTION OF THE PREFERRED EMBODIMENTS

Before the present tape-supported yo-yo is described in detail in terms of its preferred embodiment, it is to be understood that this invention is not limited to the particular arrangement of parts shown, as such devices may, of course, vary. It is also to be understood that the terminology used herein is for the purpose of describing a particular embodiment only; it is not intended to be limiting since the scope of the present invention will be limited only by the appended claims.

Figure 1:
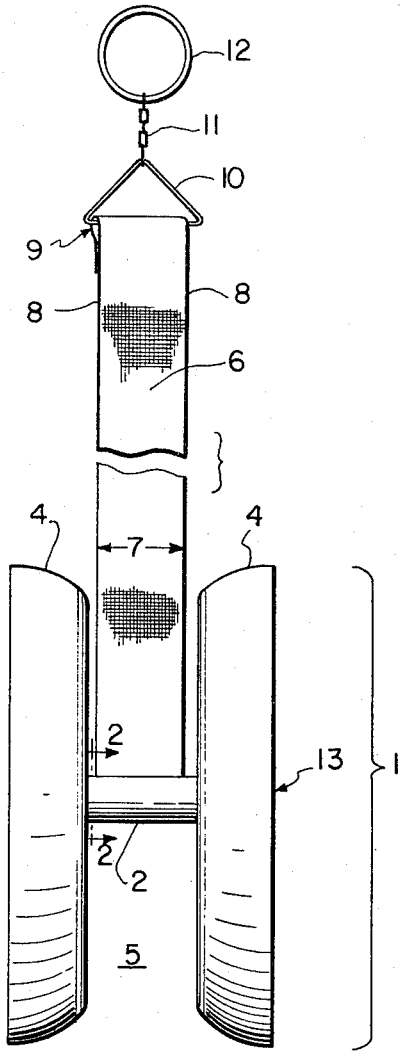
FIG. 1 is a plain front view of the present yo-yo toy.

Referring now to the drawings, and to FIG. 1 in particular which shows a plain front view of the present invention. The body of the yo-yo is referred to generally by the number 1. The body contains a single axle 2.

Figure 2:
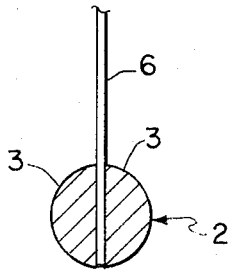
FIG. 2 is a cut-away side view of the split axle showing the tape inserted between the two axle segments, looking along the axis 13—13 of FIG. 1.

The axle 2 is split along its length, into two segments 3, as illustrated in the side-view of the axle shown in FIG. 2. The axle 2 has a pair of identical discs 4 positioned at their center points on the axle 2. The discs 4 are circular in cross-section and are separated from each other, leaving a groove 5 between the two discs 4. The discs 4 may be hollow or solid, and their faces may be flat or curved.

A flat ribbon or tape 6, of width 7, is connected at one of its ends to the axle 2. The tape 6 is inserted between the two segments 3 of the split axle 2 and tightly held by maintaining the two axle segments 3 firmly together, as illustrated in FIG. 2. The tape 6 is fixed to the axle 2 in such a manner that when the tape 6 is fully extended, the edges 8 of the tape 6 are perpendicular to the axle 2. The two axle segments 3 may be of such a design that when both axle segments 3 are placed together, in the absence of the tape, the cross-section of the assembled axle is circular. In such a case, insertion of the tape 6 between the two axle segments 3 causes the perimeter of the assembled axle 2 to depart from its circular configuration. In practice, this is not a serious problem because the tape is very thin compared to the diameter of the axle. It can, however, be avoided by designing the axle segments 3 such that when they are placed together in the presence of the tape 6, the perimeter of the axle segments conforms to the diameter of a circle as shown in FIG. 2.

A fold 9 is placed at the other end of the tape 6 by folding the tape 6 over upon itself. This fold is maintained by sewing; weaving; stapling; gluing; etc. A loop 10 passes within the fold 9. A swivel system 11, containing one or more swivel members, is connected to the loop 10. The swivel system 11 allows for rotational motion of the support 10 and the attached tape 6 and yo-yo body 1. The swivel system 11 also facilitates the removal of twists from the tape 6, when the tape 6 becomes twisted about a vertical axis.

A ring 12, for holding the yo-yo, is connected to the swivel system 11. The entire device may be held by the user by placing a finger through the ring 12.

It should be noted that one end of the tape 6 can be attached to the axle 2 by various means, such as stitching; stapling; gluing; etc. The method of attaching the tape 6 to the axle 2, by wedging the tape 6 between the two axle segments 3, which is illustrated in FIG. 2, is simply one alternative which has been found to be particularly effective and convenient. In other embodiments, the axle 2 may not be split.

The tape 6 may be comprised of a wide variety of flat elongated material, natural or synthetic. Among the materials of which the tape 6 may be constituted are leather, suede, felt, jute, hair, various types of skin, fiber glass, various cloth materials, such as wool, silk, cotton, linen, satin, velvet, carbon cloth, and/or synthetic plastics or polymers, such as polyester, polyethylene, polypropylene, polyolefins, nylon, acrylic, rayon, acetate, or various blends of the above-listed materials. The tape 6 may have parallel sides as shown within FIG. 1, or the sides of the tape 6 may be non-parallel. The tape 6 may have a woven texture or it may consist of a non-woven material. However, the inventor has discovered that grosgrain tape or ribbon is particularly well adapted for use in connection with the present invention. Grosgrain tape is characterized by having a corrugated pattern with ridges and grooves normal to the sides 8 of the tape 6. This type of tape exhibits a significant resistance to twisting about its longitudinal axis, compared to most cloth tapes. Consequently, when the grosgrained tape is forcibly twisted it has a strong tendency to become untwisted again. If, during operation of the yo-yo it is swung to the side, along a direction parallel to its axis 13—13, it will undergo a severe gyroscopic precession about the vertical axis. The twisting which is induced in the tape as a result of this precessional rotation is readily and rapidly undone by the propensity of the grosgrained tape to exist in an untwisted configuration. This untwisting is partially effected through the induced rotation of the yo-yo body 1 in the opposite direction to the twisting originally caused by the precession. More importantly, the swivel system 11 is very effective in relieving these twists, as a result of the torque caused by the twisted grosgrain tape. Another advantage of the grosgrained tape is its ability to remain straight along its width 7, and to resist wrinkling or warping along this dimension. Furthermore, if the tape is forced to become twisted about a vertical axis, resulting in the tape adopting a 'spiral staircase' type of configuration, the corrugated lines still remain in horizontal alignment, thus maintaining the axle 2 of the yo-yo in a horizontal orientation.

The yo-yo of the present invention is operated in essentially the same manner as a conventional yo-yo. The tape 6 may be wound around the axle 2 of the yo-yo simply by wrapping it by hand; or alternatively, the yo-yo body 1 may be placed on the ground or some other surface and pulled forward by means of the tape 6. This causes the body 1 of the yo-yo to roll, with a consequent winding of the tape 6 about the axle 2. To initiate operation of the yo-yo, the body 1 of the yo-yo may be held in one hand and the end of the tape 6 or the holding ring 12 may be held in the other hand. The body 1 of the yo-yo is allowed to fall free while still holding one end of the tape 6 or ring 12. As the body 1 of the yo-yo falls under the influence of gravity, the body 1 is forced to rotate, with consequent unwrapping of the tape 6 from around the axle 2. When the tape 6 has become completely unwound, the body 1 of the yo-yo has acquired considerable angular momentum. This angular momentum forces the body 1 of the yo-yo to continue rotating, thus winding the tape 6 about the axle 2 in the opposite sense to the manner in which it was wrapped around the axle during its previous downward swing. Consequently, the body 1 of the yo-yo is forced to rise upward again. A gentle upward impulse applied to the tape 6 just prior to the yo-yo body 1 reaching the bottom-most part of its swing, allows the up-down oscillation of the yo-yo body 1 to continue indefinitely. This applied impulse compensates for both frictional loss of energy and dissipation of the translational component of the energy which occurs at the bottom of the yo-yo swing, when the body 1 of the yo-yo is forced to change the direction of its translational motion.

Since the tape 6 automatically winds neatly on top of itself, in a spiralling manner, during the upward swing of the yo-yo body 1, a very smooth motion is experienced by the yo-yo. On the other hand, in many string yo-yos the string is not constrained to wrap neatly on top of itself, and can meander somewhat over the axle. Furthermore, when using a string yo-yo, the string sometimes piles up on top of itself in one region and then collapses, resulting in a more jerky motion of the toy.

The major advantage of the tape-supported yo-yo of the present invention is the very pronounced horizontal stabilization of the axle 2. This horizontal stabilization results from the fact that the axle 2 is suspended from a continuous array of points, along the width 7 of the tape 6. Any attempt to displace the yo-yo axle 2 from the horizontal alignment automatically results in the introduction of an opposing torque tending to realign the axle 2 to the horizontal position.

The most advantageous feature of the present yo-yo compared to the conventional yo-yos and prior modifications thereof is its remarkable facility to recover, even after experiencing the most severe gyroscopic precession. For example, if during operation of the yo-yo it is vigorously swung sideways, that is, in a direction parallel to the yo-yo axis 13—13, it experiences a severe gyroscopic precession about a vertical axis; this behavior is common to all yo-yos and generally results in total loss of control over the yo-yo motion. However, in the case of the tape-supported yo-yo of the present invention the twisting of the tape 6, induced by the precessional rotation is rapidly and automatically eliminated; at the same time, the fact that the portion of the axle 2 between the two discs 4 is supported over most of its length by the tape 6, helps to retain the horizontal alignment of the axle 2 even when it is undergoing precessional rotation. If the horizontal alignment of this yo-yo is disturbed, it is readily regained again. This combination of unique features embodied in the tape-supported yo-yo allows this yo-yo to rapidly recover from its precessional problem and to continue its proper motion. These highly advantageous features are not embodied in the conventional string yo-yo, or prior modifications thereof.

The inventor has found that a tape width of 16 millimeters works particularly well when the tape is comprised of grosgrain polyester, and connected to an axle having a diameter of 6 millimeters, which is in turn connected to discs having diameters of 52 millimeters.

It is possible to fabricate the body 1 of the yo-yo from a variety of materials, such as wood; plastic; metal; etc. The body 1 of the yo-yo could be molded or turned as one complete unit, or the disc 4 and axle 2 portions could be made separately and then fastened together by various means, including but not limited to gluing; screwing; wedging; soldering; welding; etc. When the tape 6 is attached to the axle 2 by wedging it between the two axle segments 3, as illustrated in FIG. 2, it is convenient to hold the two axle segments 3 tightly together by wedging the axle segments 3 into holes in the centers of the discs 4. The axle segments 3 can be simply wedged in this manner, or they may also be glued; soldered; welded; etc. to make a more permanent bond.

The use of a ribbon or tape 6, instead of a string provides scope for introducing ornamental design features not possible with the conventional string yo-yo. The tape may be made of brightly colored material or multicolored material and may have various designs along its length. These features should make the yo-yo of the present invention more colorful and interesting, and consequently more attractive to children.

The instant invention is shown and described in what is considered to be the most practical and preferred embodiment. It is recognized, however, that departures may be made therefrom, which are within the scope of the invention, and that obvious modifications will occur to one skilled in the art.

I claim:

1. A toy capable of combined rotational motion about a horizontal axis and translational motion in a vertical direction, comprising:

an axle;

a first disc connected at a center point to said axle;

a second disc connected at a center point to said axle; and a torsion resistant tape connected at one end to said axle at a position between said first disc and said second disc said tape being connected to said axle in such a manner that said tape winds around and unwinds from said axle during said rotational motion about said horizontal axis and translational motion in said vertical direction.

2. A toy capable of combined rotational motion about a horizontal axis and translational motion in a vertical direction as in claim 1, further comprising:

a swivel system connected at the other end of said tape; and a ring for holding the toy attached to said swivel system.

3. A toy capable of combined rotational motion about a horizontal axis and translational motion in a vertical direction as claimed in claim 1, further comprising a swivel system means connected at the other end of said tape.

4. A toy capable of combined rotational motion about a horizontal axis and translational motion in a vertical direction as claimed in any of claims 1, 2 or 3, wherein said tape is a grosgrain tape.

* * * * *